US008472586B2

(12) United States Patent
Ueda et al.

(10) Patent No.: US 8,472,586 B2
(45) Date of Patent: Jun. 25, 2013

(54) X-RAY SOURCE AND X-RAY PHOTOGRAPHING APPARATUS INCLUDING THE SOURCE

(75) Inventors: Kazuyuki Ueda, Tokyo (JP); Osamu Tsujii, Kawasaki (JP); Takao Ogura, Sagamihara (JP); Ichiro Nomura, Atsugi (JP)

(73) Assignee: Canon Kabushiki Kaisha, Tokyo (JP)

( * ) Notice: Subject to any disclaimer, the term of this patent is extended or adjusted under 35 U.S.C. 154(b) by 288 days.

(21) Appl. No.: 13/053,002

(22) Filed: Mar. 21, 2011

(65) Prior Publication Data

US 2011/0255664 A1 Oct. 20, 2011

(30) Foreign Application Priority Data

Apr. 14, 2010 (JP) ..... 2010-093429

(51) Int. Cl.
*H01J 35/00* (2006.01)

(52) U.S. Cl.
USPC ..... 378/121; 378/124; 378/143

(58) Field of Classification Search
USPC ..... 378/119, 121, 124, 143, 144
See application file for complete search history.

(56) References Cited

U.S. PATENT DOCUMENTS 6,975,703 B2 12/2005 Wilson et al. ..... 378/124

FOREIGN PATENT DOCUMENTS

| | | |
|---|---|---|
| JP | 2003-007237 A | 1/2003 |
| JP | 2005-158474 A | 6/2005 |
| JP | 2009-193861 A | 8/2009 |

*Primary Examiner* — Courtney Thomas
(74) *Attorney, Agent, or Firm* — Canon U.S.A., Inc. IP Division

(57) ABSTRACT

An X-ray source includes an electron-beam generating unit that generates an electron beam, and a transmission type target electrode to be irradiated with the electron beam to generate X-ray radiation. A plurality of convex portions each having an inclined surface with respect to an incident direction of the electron beam is formed on a surface of the transmission type target electrode.

8 Claims, 7 Drawing Sheets

X-RAY SOURCE AND X-RAY PHOTOGRAPHING APPARATUS INCLUDING THE SOURCE

BACKGROUND OF THE INVENTION

1. Field of the Invention

The present invention relates to radiation imaging, more specifically to an X-ray source and an X-ray photographing apparatus each including a transmission type target electrode.

2. Description of the Related Art

A thermionic source is conventionally used as an electron source of an X-ray generating apparatus. In an X-ray generating apparatus that uses a thermionic source, part of thermally emitted electrons (thermions) emitted from a filament heated to high temperature are formed into an electron flux of a predetermined shape through a Wehnelt electrode, an extraction electrode, an accelerating electrode, and a lens electrode; and the electron flux is accelerated to have high energy. A target electrode including a metal such as tungsten is irradiated with the electron flux, thereby generating X-rays. As the thermionic source, there is known a small-sized thermionic source such as an impregnated hot-cathode electron emission element that is also known as an electron source of a cathode-ray tube.

It is to be noted, however, that out of entire energy that the electron flux possesses, only about 1% or less of the energy is converted into X-rays while the remainder becomes heat. Since the target electrode resides within a vacuum chamber, most of the heat is radiated as radiant heat. If heat radiation is not effectively evacuated from the vacuum chamber, then temperature of the target electrode rises and the target electrode often melts. Because of this, the conventional X-ray generating apparatus is designed to reduce a quantity of electrons colliding on the target electrode per unit area and to adjust the energy applied to the target electrode per unit area. To reduce the quantity of electrons per unit area, it is effective to increase an electron irradiation area.

On the other hand, a portion of the target electrode against which electrons collide serves as an X-ray generation unit. The X-ray generation unit cannot be excessively enlarged since a size of the X-ray generation unit has an effect on resolution of an X-ray detector.

To realize both a reduction in the quantity of electrons per unit area and an improvement in the resolution, a technique for tilting a surface of the target electrode with respect to an electron irradiation direction and a technique for providing very small irregularities on the surface of the target electrode have been proposed. However, when the technique for tilting the surface of the target electrode and that for providing very small irregularities on the surface of the target electrode are adopted, the X-ray generating apparatus effects different focal sizes according to X-ray extraction directions and the resolution tends to deteriorate. This is because an area of a region irradiated with an electron-beam geometrically changes depending on the X-ray extraction direction. Since the deterioration in the resolution is possible, a user performing X-ray photography needs to check a tilt direction of an X-ray target and make settings to arrange the X-ray target in consideration of regions where the focal size is apparently small when X-ray photographing requires high resolution. In other words, it is a burden on the user to make complicated preparations for the X-ray photography that requires high resolution when the conventional X-ray generating apparatus is used.

SUMMARY OF THE INVENTION

The present invention is directed to an X-ray source and an X-ray photographing apparatus capable of suppressing a change in a focal size according to an irradiation direction.

According to an aspect of the present invention, an X-ray source includes an electron-beam generation unit generating an electron beam, and a transmission type target electrode to be irradiated with the electron beam to generate an X-ray, wherein a plurality of convex portions each having an inclined surface with respect to an incident direction of the electron beam is formed on a surface of the transmission type target electrode. According to the present invention, it is possible to suppress a change in a focal size of the X-ray according to an irradiation direction while radiating heat of the transmission type target electrode with high efficiency.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Various exemplary embodiments, features, and aspects of the invention will be described in detail below with reference to the drawings.

Figure 1:
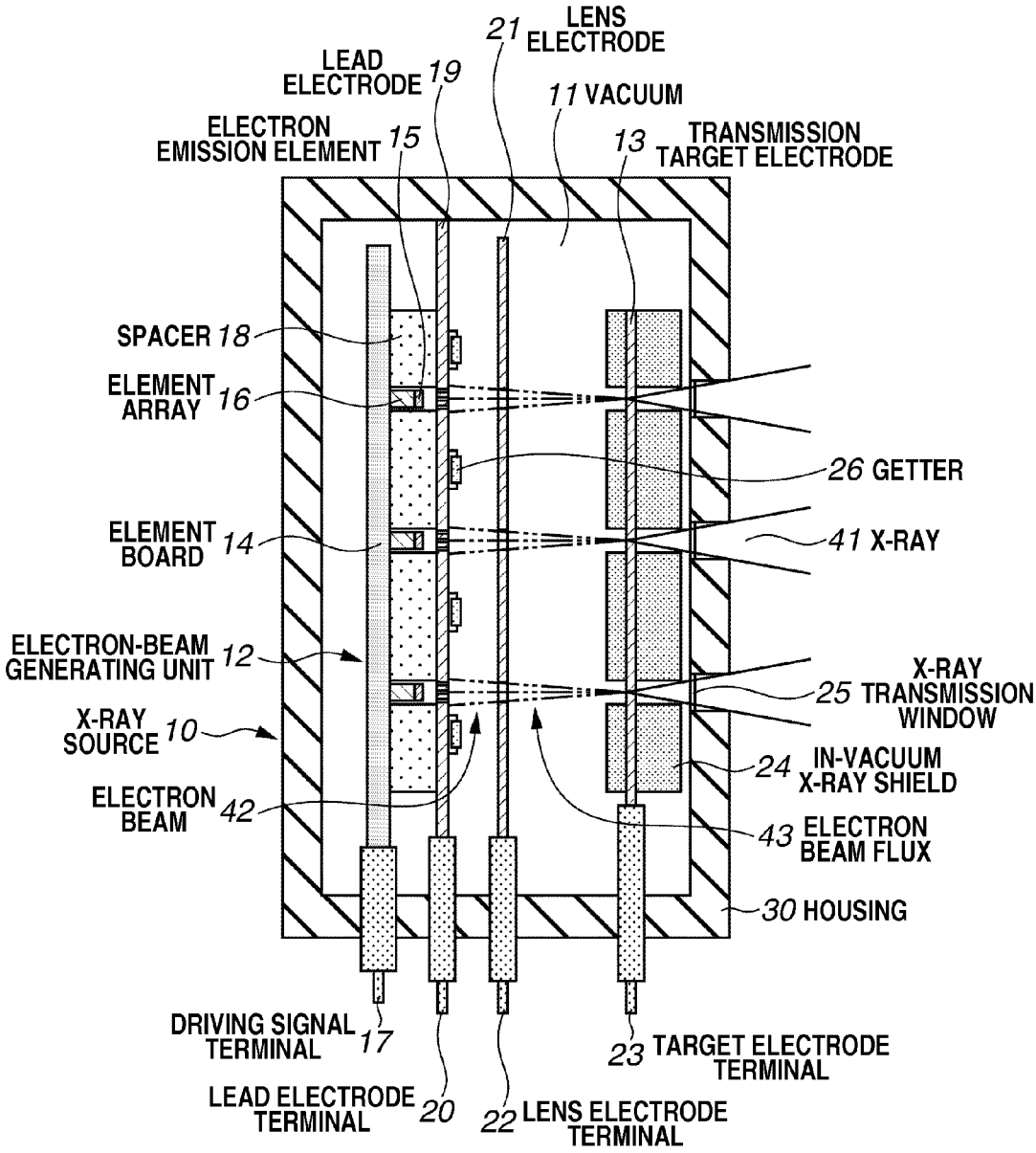
FIG. 1 illustrates an internal configuration of an X-ray source according to a first exemplary embodiment of the present invention.
Figure 2:
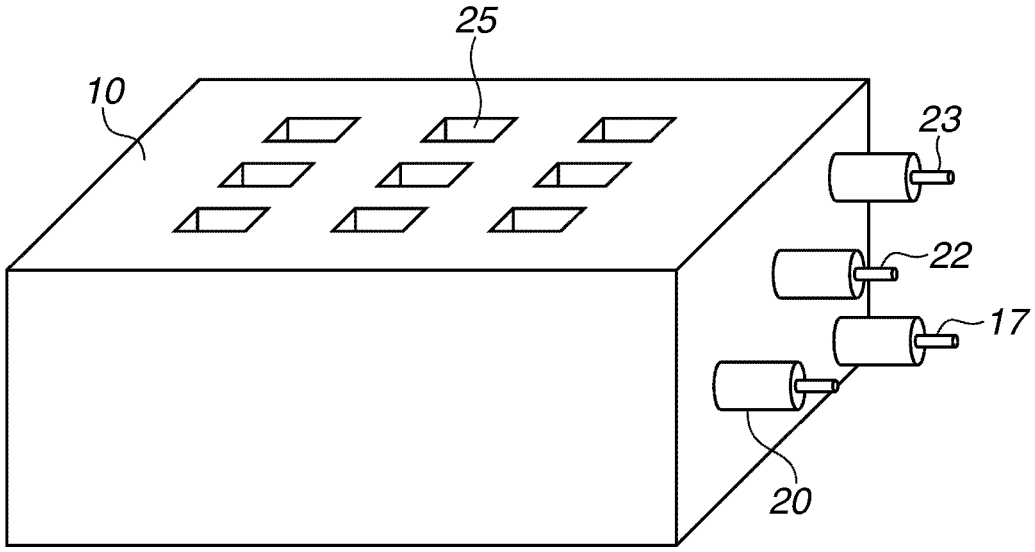
FIG. 2 is an external view of the X-ray source according to the first exemplary embodiment.

An X-ray source according to a first exemplary embodiment of the present invention will first be described. FIG. 1 illustrates an internal configuration of the X-ray source according to a first exemplary embodiment of the present invention. FIG. 2 is an external view of the X-ray source according to the first exemplary embodiment.

In an X-ray source 10 according to the first exemplary embodiment, an interior of a housing 30 is a vacuum chamber 11. An electron-beam generating unit 12 and a transmission type target electrode 13 are arranged in the vacuum chamber 11. An element board 14 and an element array 16 are provided in the electron-beam generation unit 12. The element array 16 is made of a high-melting-point metal such as molybdenum and has a diameter of, for example, 5 mm. An electron emission element 15 is mounted on a top of the element array 16.

Figure 3:
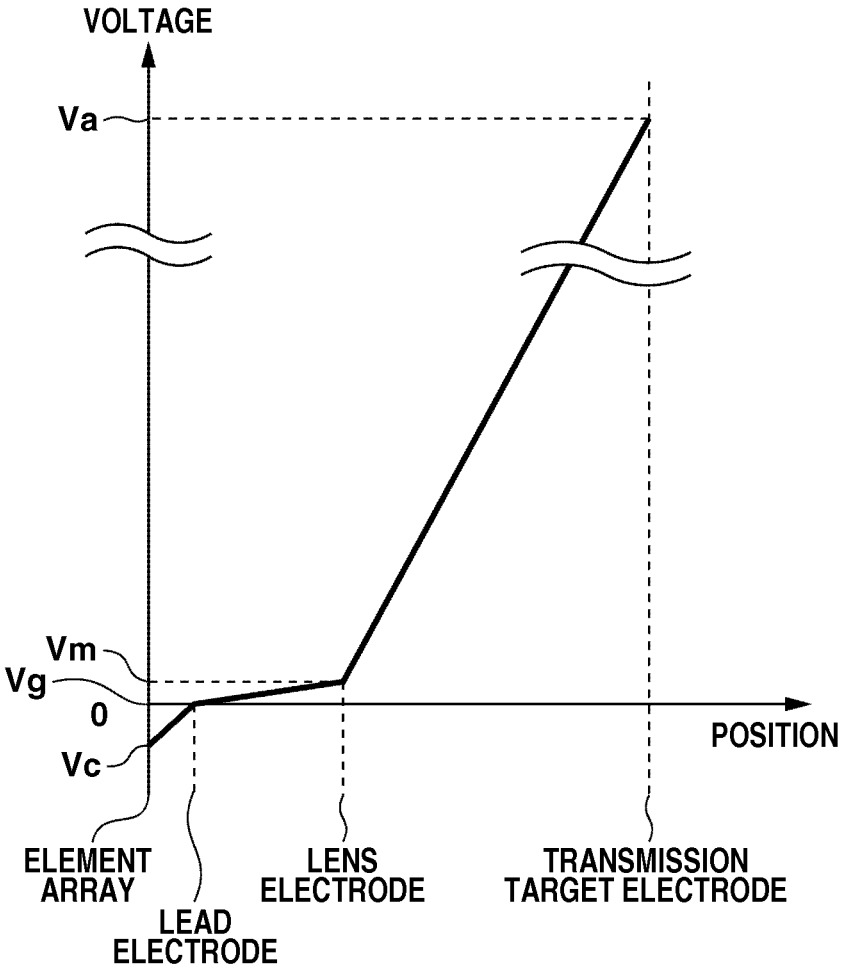
FIG. 3 illustrates applied voltages to respective units of the X-ray source with respect to a position thereof.

For example, an impregnated hot-cathode electron emission element is used as the electron emission element 15. Alternatively, a cold-cathode electron emission element using carbon nanotubes having a fine structure of several nanometers can be used as the electron emission element 15. A bottom of the element array 16 is connected to a driving interconnection of the element board 14. The driving interconnection of the element board 14 is connected to a driving signal terminal 17. The driving signal terminal 17 penetrates the housing 30, and a signal controlling a quantity of emitted electrons from the electron emission element 15 is input to the driving signal terminal 17. Accordingly, the signal input to the driving signal terminal 17 controls X-rays to be turned on or off. As illustrated in FIG. 3, a voltage Vc of, for example, about −0.01 kV to −0.2 kV is supplied to the element array 16 from the driving signal terminal 17.

A degree of vacuum of the vacuum chamber 11 is set to be, for example, equal to or lower than about $10^{-4}$ Pa to $10^{-8}$ Pa for electron emission. If the degree of vacuum is higher, a life of the electron emission element 15 becomes longer and problems such as a decrease in discharge hardly occur.

A spacer (space-regulating member) 18 having a thickness larger than a total thickness of the element array 16 and the electron emission element 15 is arranged on the element board 14. An opening matched to the element array 16 and the electron emission element 15 is formed in the spacer 18. A lead electrode 19 (i.e., an electrode made of lead) is arranged on the spacer 18. A surface of the lead electrode 19 facing the electron emission element 15 is distanced from the electron emission element 15 by about several hundreds of μm. Accordingly, the lead electrode 19 is electrically isolated from the electron emission element 15 and element array 16 by a gap formed therebetween. A plurality of grid-like through-holes is formed in a portion of the lead electrode 19 which portion is opposed to the electron emission element 15. For example, a plane shape (cross-section) of each through-hole is a square having a side about 0.40 mm long and a distance between the through-holes is about 0.1 mm. The lead electrode 19 is configured so that the through-holes are formed in a tungsten sheet having a thickness of about 0.2 mm. The lead electrode 19 is connected to a lead electrode terminal 20. The lead electrode terminal 20 penetrates the housing 30 and a voltage controlling an electric field to be applied to the electron emission element 15 is supplied to the lead electrode terminal 20. As illustrated in FIG. 3, a voltage Vg of, for example, 0 kV is supplied from the lead electrode terminal 20 to the lead electrode 19. If a potential difference occurs between the lead electrode 19 and the element array 16, then the electron emission element 15 emits electrons and electron beams are passed through the lead electrode 19.

It is to be noted that the shape, size, arrangement and the like of the through-hole of the lead electrode 19 are not limited to specific ones as long as a uniform electric field can be applied to the electron emission element 15. In addition, an insulating layer and an interconnection may be provided on a surface not facing the electron emission element 15 of the lead electrode 19 for a getter 26. The getters used herein may be wires or sheets of materials, such as barium and the like, which are usually heated to maintain the level of vacuum inside the vacuum chamber 11.

A lens electrode (an intermediate electrode) 21 is arranged between the lead electrode 19 and a transmission type target electrode 13. The lens electrode 21 is a stainless steel plate having a thickness of, for example, 2 mm. A conductive metal other than stainless steel can also be used as a material of the lens electrode 21; the conductive metal is preferably one having a high atomic number such as tantalum. The lens electrode 21 is connected to a lens electrode terminal 22. The lens electrode terminal 22 penetrates the housing 30, and a voltage for converging electron beams 42 passed through the lead electrode 19 to generate electron beam fluxes 43 is supplied to the lens electrode terminal 22. As illustrated in FIG. 3, a voltage Vm of, for example, about 0 kV to 10 kV is supplied from the lens electrode terminal 22 to the lens electrode 21. As a result, the electron beam fluxes 43 are obtained, which have a diameter converged to about 0.3 mm to 2 mm.

An in-vacuum X-ray shield 24 contacting the transmission type target electrode 13 mechanically and thermally is provided around the transmission type target electrode 13. Openings through which the electron beams 43 are introduced to and through which X-rays emitted from the transmission type target electrode 13 are formed in the in-vacuum X-ray shield 24. Heat generated in the transmission type target electrode 13 is emitted via the in-vacuum X-ray shield 24. The transmission type target electrode 13 is connected to a target electrode terminal 23. The target electrode terminal 23 penetrates the housing 30 and a voltage accelerating the electron beam fluxes 43 is applied to the target electrode terminal 23. As illustrated in FIG. 3, a high voltage Va of, for example, about 40 kV to 120 kV is supplied from the target electrode terminal 23 to the target electrode 13. As a result, the electron beam fluxes 43 collide against the transmission type target electrode 13 at high speed to generate X-rays 41. Although the X-rays 41 are transmitted through the transmission type target electrode 13, a part of the X-rays 41 is shielded by the in-vacuum X-ray shield 24 and emitted at a predetermined angle of X-ray radiation.

X-ray transmission windows 25 are provided at positions of the housing 30 which are irradiated with the X-rays 41, respectively, and the X-rays 41 are transmitted through the X-ray transmission windows 25 and radiated to outside of the X-ray source 10. A material of the X-ray transmission windows 25 is, for example, aluminum, beryllium alloy or glass.

Figure 4A:
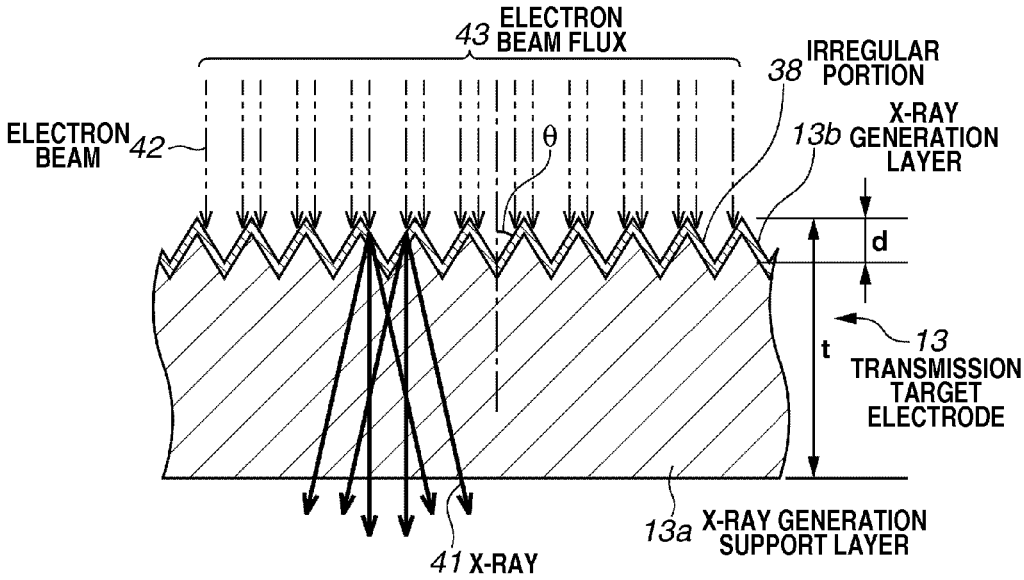
FIGS. 4A and 4B illustrate a structure of a transmission type target electrode according to the first exemplary embodiment.
Figure 4B:
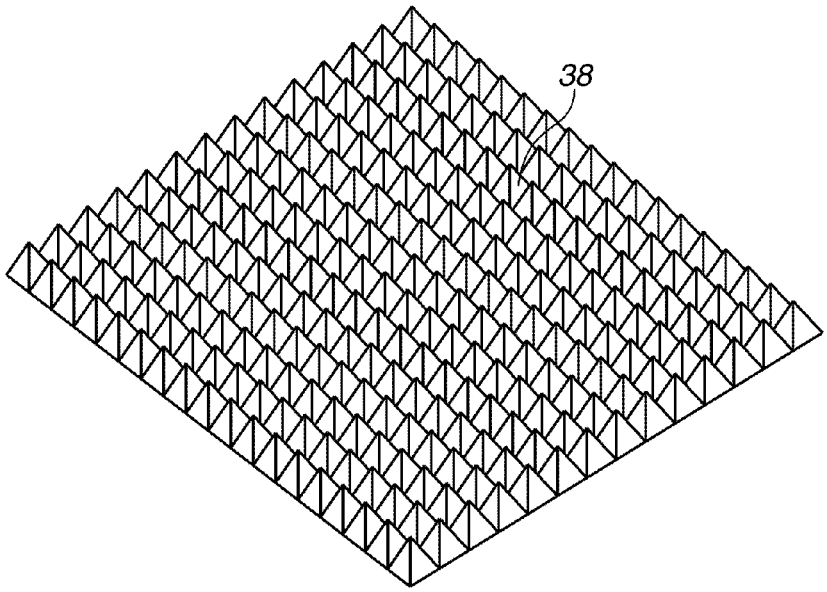

The transmission type target electrode 13 will be now described in more detail. FIGS. 4A and 4B illustrate a structure of the transmission type target electrode 13 according to the first exemplary embodiment. FIG. 4A is a cross-sectional view and FIG. 4B is a perspective view of the transmission type target electrode 13.

As illustrated in FIGS. 4A and 4B, an X-ray generation layer 13*b* is formed on an X-ray generation support layer 13*a* of the transmission type target electrode 13. A substrate (base) made of, for example, a light element is used as the X-ray generation support layer 13*a*. Examples of material for the X-ray generation support layer 13*a* include materials having low X-ray absorption power such as diamond, carbon, beryllium, Al, AlN and SiC. Alternatively, a combination of two or more types of these materials can be used as the material of the X-ray generation support layer 13*a*. A thickness of the X-ray generation support layer 13*a* is, for example, about 0.1 mm to a few mm. Examples of a material of the X-ray generation layer 13*b* include heavy metals such as tungsten and molybdenum. A thickness of the X-ray generation layer 13*b* is, for example, about several tens of nm to a few μm. Accordingly, a thickness t of the transmission type target electrode 13 is, for example, about 0.5 mm.

Furthermore, in this exemplary embodiment, irregular portions 38 are formed on a surface of the X-ray generation support layer 13*a* and the X-ray generation layer 13*b* is formed to imitate these irregular portions. Because of this, the irregular portions 38 are present on a surface of the transmission type target electrode 13. A shape of each convex portion of the irregular portions 38 is, for example, a quadrangular pyramid and a height d of the irregular portion 38 is about 0.05 mm. An angle θ formed between the convex portion of the irregular portions 38 and an incident direction of the X-rays 41 is set to, for example, 45 degrees.

Because of the appropriate material and appropriate thickness of the X-ray generation layer 13*b* of the transmission type target electrode 13, the transmission type target electrode 13 maximizes the generation of X-rays 41 and minimizes absorption and attenuation of the X-rays 41. Furthermore, because of the appropriate material and appropriate thickness of the X-ray generation support layer 13*a*, it is possible to cool with high efficiency the X-ray generation layer 13*b*, the temperature of which has risen by irradiation of the electron beam fluxes 43. In addition, it is difficult for the transmission type target electrode 13 to absorb the X-rays 41 and its strength is hard to attenuate. Moreover, the X-ray generation support layer 13*a* is high in heat conductivity and excellent in transmission of the X-rays 41. Besides, the X-ray generation support layer 13*a* functions as a filter that effectively absorbs low energy X-rays 41, which may deteriorate image quality of an X-ray transmission image, in a low energy region of the X-rays 41 and changes a radiation quality of X-rays 41. Therefore, the transmission type target electrode 13 shows high efficiency in generating X-rays 41 and enhanced functionality.

Further, an effective surface area of the transmission type target electrode 13 is about twice as large as that of a plane (flat) electrode since the irregular portions 38 having the appropriate shape and appropriate size are formed on the surface of the transmission type target electrode 13. Due to this, electron energy applied to the transmission type target electrode 13 per unit surface area is about a half of that of the plane electrode. It is, therefore, possible to suppress a surface temperature of the transmission type target electrode 13 from rising excessively.

Moreover, the heat from a certain inclined surface of one of the convex portions 38 can be efficiently radiated without irradiation on an adjacent inclined surface since the angle e of the inclined surface of each convex portion of the irregular portions 38 with respect to the incident direction of the X-rays 41 is 45 degrees. As stated above, the heat is also radiated via the in-vacuum X-ray shield 24 (heat radiation member), which surrounds the transmission type target electrode 13. According to this exemplary embodiment, therefore, it is possible to apply electric power to such a degree as to be able to radiate with X-rays 41 in sufficient amounts to easily transmit through the subject.

Furthermore, as stated above, the X-rays 41 are generated from surfaces of the irregular portions 38 if the electron beam fluxes 43 of the electron beams 42 collide against the irregular portions 38. At this time, a radiation direction of the X-rays 41 is a set of irradiation directions of X-rays generated from respective parts of the very small irregular portions 38. Therefore, the portions from which the X-rays 41 are generated are almost same irrespective of the irradiation direction of the X-rays 41. In addition, a focal size of the X-rays 41 is kept almost constant since the X-rays 41 are emitted from substantially identical inclined surfaces of the plurality of irregular portions 38. It is, therefore, possible to suppress a change in resolution depending on the irradiation direction of the X-rays 41.

Figure 5A:
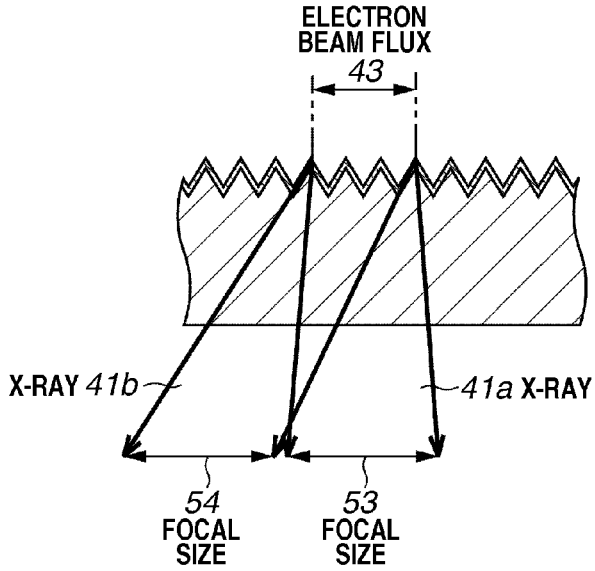
FIGS. 5A, 5B, and 5C illustrate comparative relationships between the target electrode and a focal size.

FIG. 5A illustrates a manner in which the transmission type target electrode 13 may control the focal size of X-rays 41 to be maintained substantially constant even when the direction of irradiation is changed. For example, as illustrated in FIG. 5A, a focal size 53 of an X-ray 41*a* radiated from the surface of the transmission type target electrode 13 in the incident direction of the electron beam fluxes 43 is equal to a focal size 54 of an X-ray 41*b* radiated therefrom in a direction inclined from the incident direction of the electron beam fluxes 43. Thus, the change in resolution due to direction of irradiation can be effectively suppressed.

Therefore, according to the first exemplary embodiment, the X-rays 41 can be generated with sufficient energy and the focal size of the X-rays 41, in other words, an electron irradiation area can be made stable irrespective of the irradiation direction. Accordingly, if the X-ray source 10 of the present invention is used, it is possible to perform X-ray photographing with substantially the identical resolution on the entire surface of an X-ray sensor.

Figure 5B:
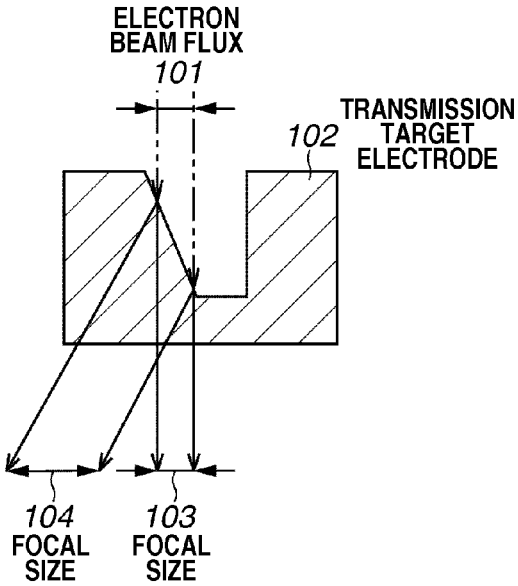
Figure 5C:
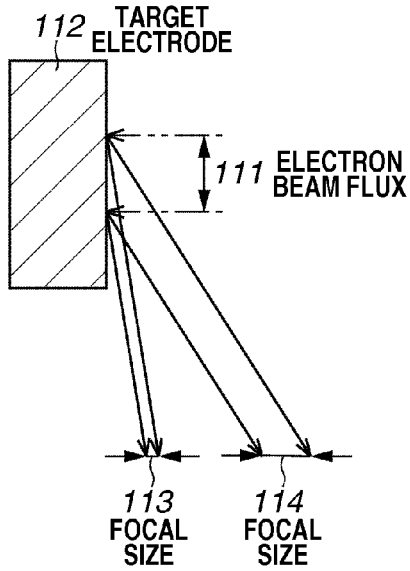

In contrast, FIGS. 5B and 5C illustrate the manner in which conventional target electrodes affect the focal size of X-rays when the direction of irradiation is changed.

Specifically, if a transmission type target electrode 102 having an inclined surface illustrated in FIG. 5B is used, a focal size 103 of X-rays radiated from a surface of the transmission type target electrode 102 in an incident direction of an electron beam flux 101 could be far smaller than a focal size 104 of X-rays radiated in a direction inclined from the incident direction of the electron beam flux 101. In this case, resolution greatly differs according to an irradiation direction of X-rays. This problem occurs in a technique discussed, for example, in U.S. Pat. No. 6,975,703.

Furthermore, if an electron beam flux 111 is emitted to a target electrode 112 illustrated in FIG. 5C, a focal size 113 of X-rays radiated from a surface of the target electrode 112 at a smaller angle could be far smaller than a focal size 114 of X-rays radiated from the surface of the target electrode 112 at a larger angle. In this case, resolution greatly differs according to an irradiation direction of X-rays. This problem occurs in a technique discussed, for example, in Japanese patent application laid open No. 2005-158474.

Figure 6:
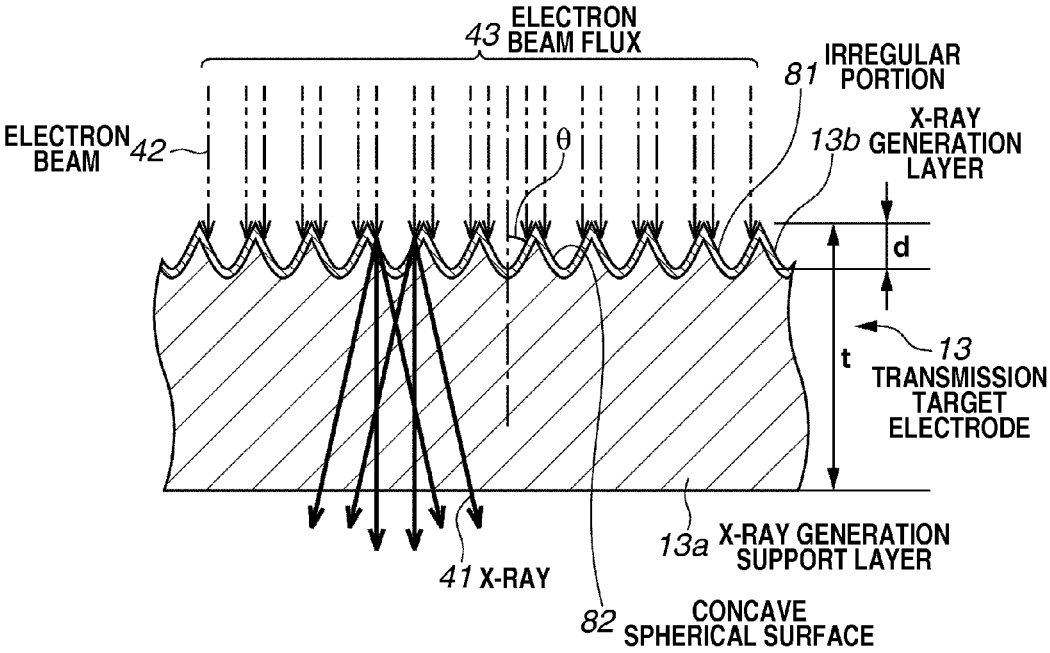
FIG. 6 illustrates a structure of a transmission type target electrode according to a second exemplary embodiment of the present invention.
Figure 7:
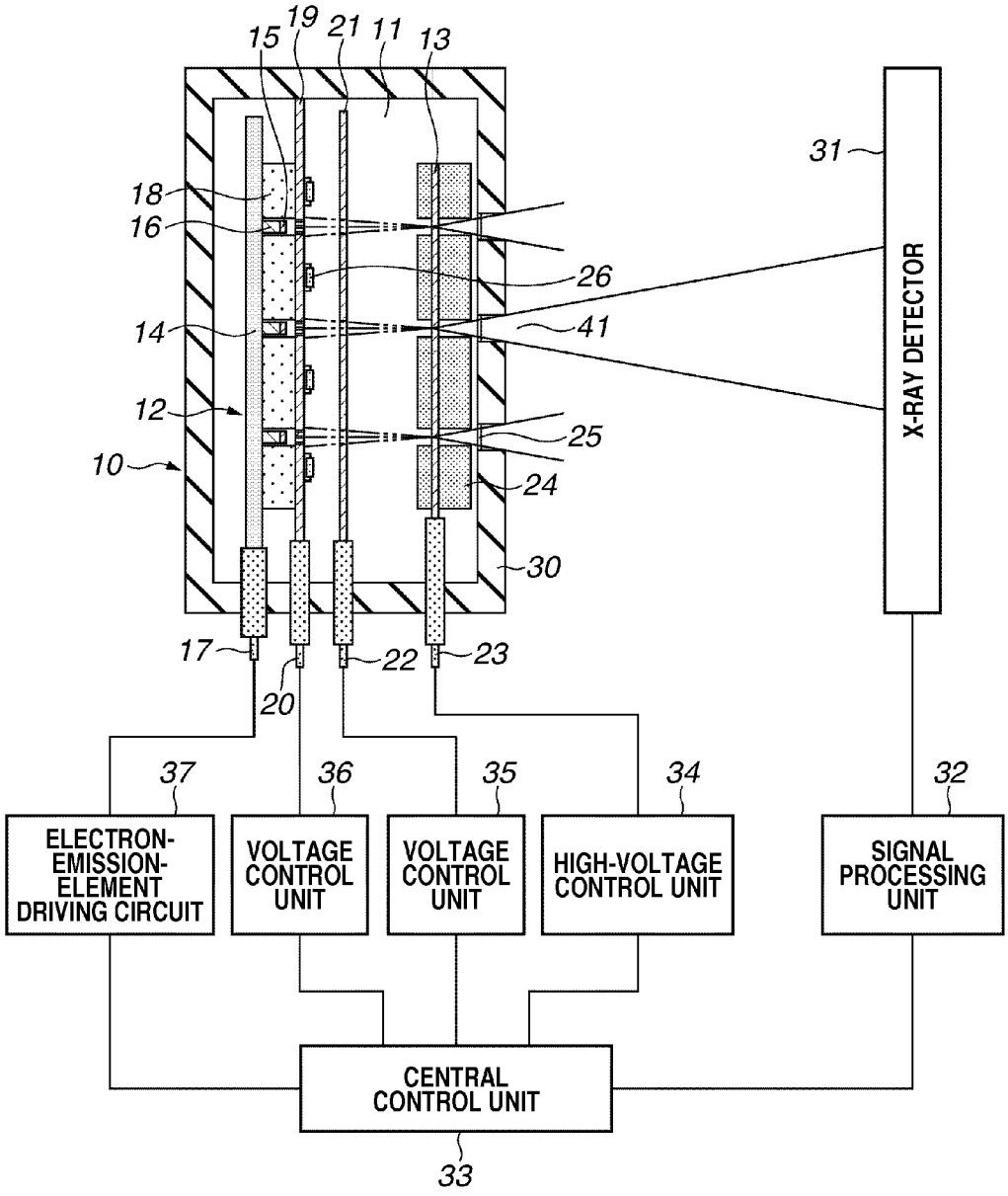
FIG. 7 illustrates a configuration of an X-ray photographing apparatus according to a third exemplary embodiment of the present invention.

An X-ray source 10 according to a second exemplary embodiment of the present invention will be described with reference to FIG. 6. FIG. 6 illustrates a structure of a transmission type target electrode 13 of the X-ray source 10 according to the second exemplary embodiment of the present invention. The transmission type target electrode 13 according to the second exemplary embodiment of the present invention is substantially similar to that of the first embodiment in structure and dimensions. Thus, a repetitive description of similar features will not be provided.

In the first exemplary embodiment, the convex portions of the irregular portions 38 are connected to one another via bases of quadrangular pyramids. In the second exemplary embodiment, by contrast, irregular portions 81 in which convex portions are connected to one another via concave spherical surfaces 82 are formed on the surface of the transmission type target electrode 13. A radius of curvature of each concave spherical surface 82 is about 0.01 mm.

The second exemplary embodiment can attain similar advantages as those of the first exemplary embodiment. Furthermore, even if temperature of the transmission type target electrode 13 rises and thermal stress occurs following irradiation of the electron beam fluxes 43, stress concentration can be relaxed because of the presence of the concave spherical surfaces 82. Therefore, as compared with the first exemplary embodiment, the formation of surface cracks are minimized and reliability of the X-ray source 10 at the time of driving the X-ray source 10 can be improved.

An X-ray photographing apparatus according to a third exemplary embodiment of the present invention will be described. The X-ray photographing apparatus according to the third exemplary embodiment includes the X-ray source 10 according to the first or second exemplary embodiment. FIG.

7 illustrates a configuration of the X-ray photographing apparatus according to the third exemplary embodiment of the present invention.

An X-ray detector 31 of the X-ray photographing apparatus according to the third exemplary embodiment is disposed in a radiation direction of X-rays emitted from the X-ray source 10. At the time of photographing, a subject (not shown) is located between the X-ray-source-10 and the X-ray detector 31.

The X-ray detector 31 is connected to a central control unit 33 via a signal processing unit 32. A high-voltage control unit 34, voltage control units 35 and 36, and an electron-emission-element driving circuit 37 are also connected to the central control unit 33. The target electrode terminal 23 is connected to the high-voltage control unit 34, the lens electrode terminal 22 is connected to the voltage control unit 35, the lead electrode terminal 20 is connected to the voltage control unit 36, and the driving signal terminal 17 is connected to the electron-emission-element driving circuit 37.

In the X-ray photographing apparatus configured as stated above, the central control unit 33 controls the high-voltage control unit 34, the voltage control units 35 and 36, and the electron-emission-element driving circuit 37 to operate to generate the X-rays 41. More specifically, the electron beams 42 of electrons emitted from the electron-beam generation unit 12 of the X-ray source 10 converge into the electron beam fluxes 43, and the electron beams fluxes 43 are emitted to the transmission type target electrode 13, thereby generating the X-rays 41. The X-rays 41 are radiated to the air through the X-ray transmission windows 25 and detected by the X-ray detector 31 after being transmitted through the subject. The X-ray detector 31 converts the detected X-rays 41 into electric signals in a known manner, and forwards the electric signals to signal processing unit 32. The central control unit 33 controls the signal processing unit 32 to operate, so that the signal processing unit 32 creates an X-ray transmission image of the subject from a detection result of the X-ray detector 31. Moreover, in the third exemplary embodiment, because of use of the X-ray source 10 as set forth in the first or second exemplary embodiment, it is possible to generate the X-rays 41 with sufficient energy and to stabilize the focal size of the X-rays 41, that is, the electron irradiation area irrespective of the irradiation direction. Accordingly, the X-ray transmission image of the subject can be generated with high and substantially constant resolution.

While a shape of each convex portion of irregular portions 38 is not limited to a specific shape, the shape is preferably a conical or pyramidal shape such as a quadrangular pyramid, a triangular pyramid or a cone. The angle of the inclined surface of each convex portion with respect to the incident direction of electron beam fluxes 43 can also be constant. The angle of the inclined surface is preferably equal to or larger than 45 degrees. If the angle is smaller than 45 degrees, it is often difficult to radiate the heat. Moreover, the height of each convex portion can be equal to or smaller than 10% of the thickness of the transmission type target electrode 13. If the height of the convex portion exceeds 10% of the thickness of the transmission type target electrode 13, then the convex portions tend to be large in size and focal sizes tend to be irregular.

Furthermore, in the second exemplary embodiment, the height of each convex portion can be equal to or larger than 10 μm and the radius of curvature of each concave spherical surface 82 can be equal to or larger than 2 μm. If the radius of curvature is smaller than 2 μm, the effect of relaxing the stress concentration is reduced and radiation of heat may not be optimal. If the radius of curvature is equal to or larger than 2 μm and the overall height of the convex portion is smaller than 10 μm, the surface area of the transmission type target electrode 13 cannot be made sufficiently large. In contrast, if the height of each convex portion is equal to or larger than 10 μm and the radius of curvature of each concave spherical surface 82 is equal to or larger than 2 μm, the effective surface area is sufficiently large to effectively radiate heat and increase an electron irradiation area. It is to be noted that each concave spherical surface is not always a part of a perfectly spherical surface but suffices to be a convex curved surface.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2010-093429 filed Apr. 14, 2010, which is hereby incorporated by reference herein in its entirety.

What is claimed is:

1. An X-ray source comprising:

an electron-beam generation unit configured to generate an electron beam; and a transmission type target electrode to be irradiated with the electron beam to generate X-ray radiation, wherein a plurality of convex portions each having an inclined surface with respect to an incident direction of the electron beam are formed on a surface of the transmission type target electrode.

2. The X-ray source according to claim 1, wherein the convex portions are conical or pyramidal.

3. The X-ray source according to claim 1, wherein an angle of the inclined surface with respect to the incident direction is constant.

4. The X-ray source according to claim 1, wherein a height of the convex portions is equal to or smaller than 10% of a thickness of the transmission type target electrode.

5. The X-ray source according to claim 1, wherein an angle of the inclined surface with respect to the incident direction is equal to or greater than 45 degrees.

6. The X-ray source according to claim 1, wherein a height of the convex portions is equal to or larger than 10 μm, and wherein the plurality of convex portions is connected to one another via concave curved surfaces each having a radius of curvature equal to or larger than 2 μm.

7. The X-ray source according to claim 1, further comprising a heat radiation member disposed around the transmission type target electrode and configured to radiate heat generated in the transmission type target electrode.

8. An X-ray photographing apparatus comprising:

the X-ray source according to claim 1;

an X-ray detecting unit configured to detect the X-ray radiation generated by the X-ray source and transmitted through a subject; and a signal processing unit configured to create an X-ray transmission image from a detection result of the X-ray detecting unit.

* * * * *